United States Patent [19]

Kikuchi

[11] Patent Number: 4,542,690

[45] Date of Patent: Sep. 24, 1985

[54] HEAT-SENSITIVE PRINTING MACHINE

[75] Inventor: Reiji Kikuchi, Iwate, Japan

[73] Assignee: Kabushiki Kaisha Sato, Japan

[21] Appl. No.: 492,579

[22] Filed: May 9, 1983

[30] Foreign Application Priority Data

May 18, 1982 [JP] Japan ..... 57-71409[U]

[51] Int. Cl.[4] ..... B41F 1/44

[52] U.S. Cl. ..... 101/27; 101/318; 101/379

[58] Field of Search ..... 101/27, 31, 379, 3 R, 101/3 SP, 292, 316, 318, 9, 21, 41, 406

[56] References Cited

U.S. PATENT DOCUMENTS

| | | | |
|---|---|---|---|
| 446,587 | 2/1891 | Reynolds | 101/406 |
| 664,859 | 1/1901 | Hehr et al. | 101/9 |
| 2,301,010 | 11/1942 | Boutiette | 101/31 X |
| 2,792,778 | 5/1957 | Schlegel et al. | 101/292 X |
| 3,468,252 | 9/1969 | Lemelson | 101/379 |
| 4,223,204 | 9/1980 | Benedict | 101/9 X |

*Primary Examiner*—Edgar S. Burr
*Assistant Examiner*—Charles A. Pearson
*Attorney, Agent, or Firm*—Ostrolenk, Faber, Gerb & Soffen

[57] ABSTRACT

A heat-sensitive printing machine is disclosed. The printing machine includes a platen upon which a heat-sensitive printing medium may be placed. A printing head has raised portions defining the indicia to be printed. A heater is provided for heating the printing head. A reciprocator moves the printing head between a first position remote from the platen and a printing position wherein the raised portions contact a heat-sensitive printing medium located on the platen. The printing head is connected to the reciprocator by a pair of leaf springs whose cross-section is sufficiently small that no more than about 20% of the heat in the printing head is conducted to the reciprocator through the leaf springs.

4 Claims, 2 Drawing Figures

HEAT-SENSITIVE PRINTING MACHINE

BACKGROUND OF THE INVENTION

1. Field of the Invention

The present invention relates to a heat-sensitive printing machine for printing heat-sensitive paper or the like by the use of a printing plate formed with type, and, more particularly, to an improvement in the elastic members for elastically supporting the printing head of the heat-sensitive printing machine.

2. Description of the Prior Art

In recent years, a thermal printer has been used as a printing machine for printing the so-called "price labels", which are temporarily adhered in series to a web of backing paper and are printed with desired indicia such as the prices, production dates and/or bar codes of commodities before they are applied to the commodities. Another printing machine is also used, which is equipped with a heated printing plate formed with type bearing indicia such as the name and/or address of a shop together with a thermal head, without separately printing the aforementioned labels in advance with the the shop name and other information.

Moreover, the heat-sensitive printing machine is constructed such that a plate carriage carrying the printing plate and the heater is reciprocally moved to push the printing head against the labels, thereby effecting the heat-sensitive printing operations.

A printing plate of the type mentioned above cannot be made of an elastic material having a low heat resistance since it does not produce sufficient heat for the heat-sensitive printing operation. Rather, the printing slate must be made of a harder material such as metal. This is disadvantageous because the surfaces of the type fail to uniformly contact the surfaces of the labels if the parallelism between the label and type surface deteriorates due to any cause, such as an assembly error or wear. This results in a bad print in which the printed indicia are thin on one side.

Moreover, since the heat of the printing plate tends to be transferred by conduction from the aforementioned plate carriage to a reciprocal actuator for moving the plate carriage back and forth, there is another disadvantage in that the heat loss is uneconomically high. Still another disadvantage is that the printing plate cools down to a level lower than a proper printing temperature as a result of the heat loss, so that the print will tend to become faint or obscure.

SUMMARY OF THE INVENTION

The present invention is directed to the elimination of the foregoing disadvantages of the prior art structures.

It is, therefore, an object of the present invention to provide a heat-sensitive printing machine which uniformly brings the type surface of a printing plate into contact with the surfaces of labels without fail, thereby ensuring clean prints and reducing the loss of heat from a printing head.

According to a major feature of the present invention, a heat-sensitive printing machine is provided for pressing a hot printing plate against a heat-sensitive printing medium to print said printing medium with desired indicia, said machine comprising: a printing head including a printing plate having a plurality of type bearing desired indicia, and a heater for heating the type of said printing plate to a proper printing temperature; a reciprocal actuator for reciprocally moving said printing heat toward and away from a heat-sensitive printing medium, thereby bringing the type of said printing head into and out of contact with said heat-sensitive printing medium, printing said printing medium with the desired indicia of said type, and elastic means connecting said printing head and said reciprocal actuator. The elastic means has a sufficiently small cross-sectional area to limit the heat loss through the elastic means to no more than about 20%. By using such an elastic means, the parallelism between the surfaces of the type of said printing plate and the surface of said printing medium can be ensured and the loss of heat, which would otherwise be transferred by conduction from the printing head through said elastic means to the reciprocal actuator, can be maintained at an acceptably low level. Additionally, the small cross-sectional area of the elastic means makes it possible to maintain the printing plate at the proper printing temprature with reduced power consumption for compensating said heat loss.

BRIEF DESCRIPTION OF THE DRAWINGS

Other objects, features and advantages will become apparent from the following description taken in conjunction with the accompanying drawings, in which.

DESCRIPTION OF THE PREFERRED EMBODIMENT

Figure 1:
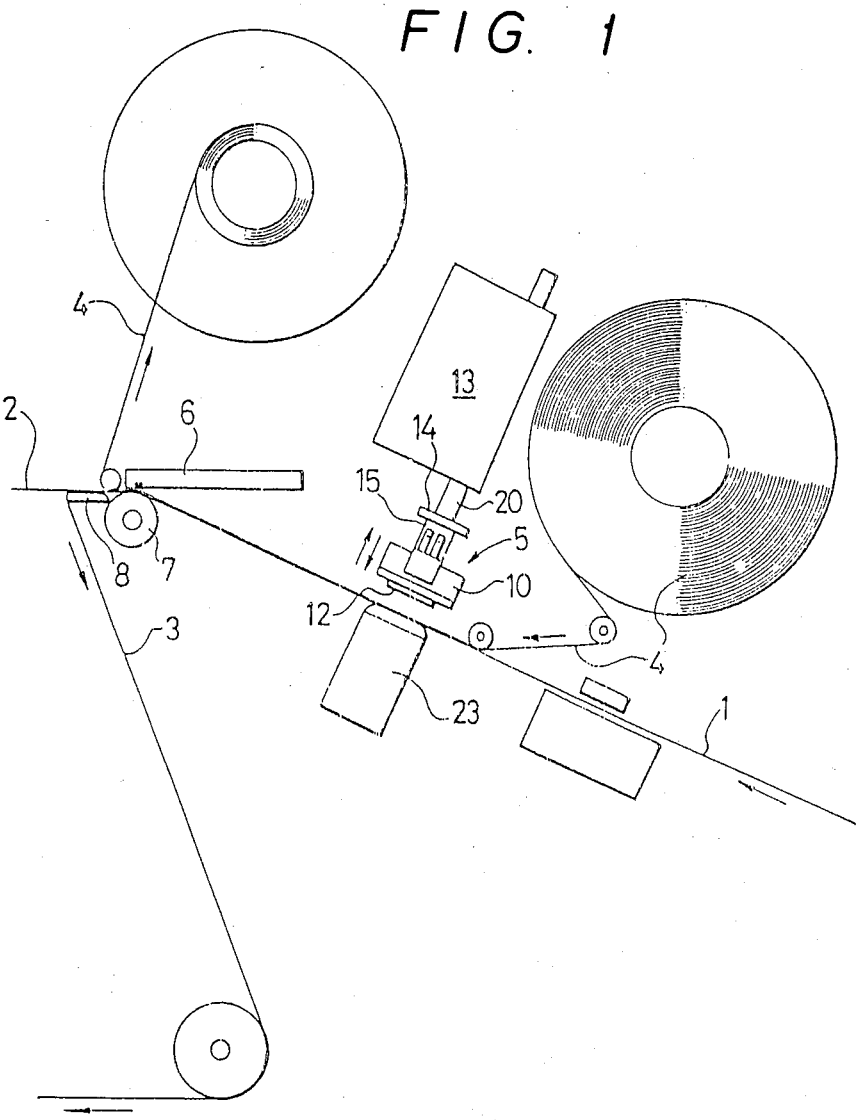
FIG. 1 is a schematic side elevational view illustrating a heat-sensitive printing machine in its entirety according to one embodiment of the present invention.

The present invention will be described in detail below in connection with the illustrated embodiment thereof with reference to the accompanying drawings. A heat-sensitive printing machine, shown in its entirety in FIG. 1, is of the heat-sensitive thermal type, in which a composite label web 1 having a number of labels 2 temporarily adhered in series to a web of backing paper 3, is fed from a source (not shown) located in its running course with a web of heat-sensitive transfer medium 4. Next, the labels 2 are initially printed by a printing head 5 with desired indicia, which are uniform to a certain extent and which contain certain information according to the prior art, such as the name, address and/or mark of a shop. The labels 2 are additionally printed by the cooperative action of a thermal head 6 and a platen 7 with other desired indicia, which are varied depending upon the respective items of commodities, such as the prices, production dates and/or bar codes of the commodities. After this, the heat-sensitive transfer material web 4 is turned upwardly and taken up, whereas the composite label web 1 is pulled to further advance until only the backing paper web 3 is delaminated and turned downwardly at the leading edge of a turning member or delaminator 8. As a result, the labels 2 further advance by their own rigidity, leaving their backing paper web 3 behind, so that they arrive in a condition in which they can be applied to commodities.

Figure 2:
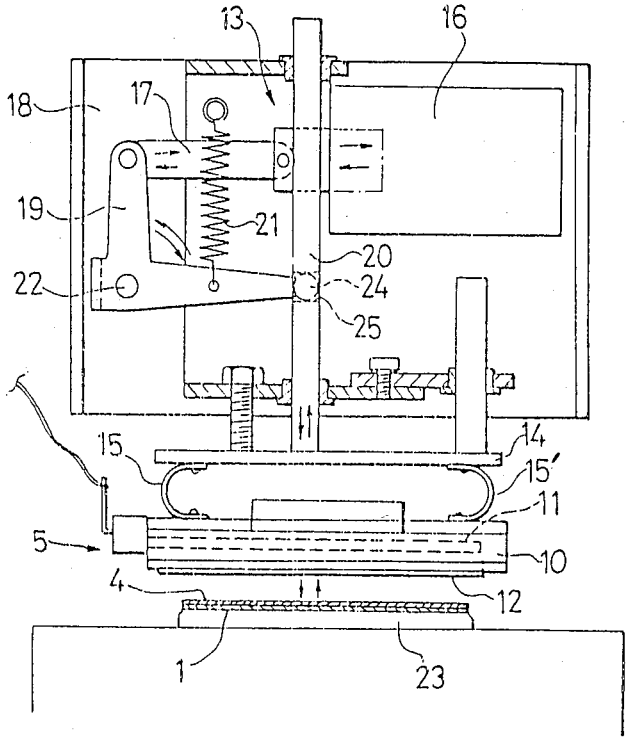
FIG. 2 is a side elevational view illustrating the detail of the printing head of the printing machine illustrated in FIG. 1.

The aforementioned printing head 5 which forms an important part of the present invention will be subsequently described with reference to FIG. 2. Indicated at reference numeral 10 in FIG. 2 is a plate carriage in which a heater 11 is located. The bottom face of the plate carriage 10 has a printing plate 12 attached thereto. The plate 12 is formed with projecting type bearing the desired indicia such as the name and/or address of the shop. The plate carriage 10 is connected by an elastic means, preferably a pair of leaf springs 15 and 15', having semi-circular shapes as viewed in FIG. 2, to a mounting plate 14 which, in turn, is attached to the lower end of a reciprocal actuator 13. In order to minimize the amount of heat that is lost via springs 15, 15', their cross-section is minimized. In the embodiment illustrated, their cross-section is preferably 0.2–0.4 mm in thickness by 5.0–10.0 mm in width for a total cross-sectional area of 1.0–4.0 $mm^2$. Whatever the particular dimensions, the amount of heat lost via springs 15, 15' is preferably no more than about 20%.

This reciprocal actuator 13 is constructed to include, in addition to the aforementioned mounting plate 14, a solenoid 16 adapted to operate in response to a signal coming from a control unit not illustrated in the body of the printing machine; a link 17 connected to the solenoid 16; an L-shaped link 19 having one end hingedly joined to the said link 17 and its central portion hinged to a machine frame 18 by means of a pin 22; and a rod 20 having a lower end to which the aforementioned mounting plate 14 is affixed. The rod is so mounted in the machine frame 18 that it can move up and down. The leading end 24 of the aforementioned L-shaped link 19 is fitted in a hole 25 which is formed in the rod 20. Additionally, reference numeral 21 indicates a return spring for biasing the L-shaped link 19 in the counter-clockwise direction at all times. More specifically, the upper ends of the leaf springs 15, 15' are connected with the mounting plate 14. The rod 20 is secured to the mounting plate 14 at its lower end and is mounted in the machine frame 18 so that it can be thereby guided to move back and forth. The L-shaped link 19 has its central portion hinged to the machine frame 18 by means of the pin 22 and its one leading end 24 hingedly joined to the body of the rod 20 by means of the hole 25. The link 17 has its one end hingedly joined to the other leading end of the L-shaped link 19. The solenoid 16 is connected to the other end of the link 17 and is adapted to pull the link 17 when the solenoid is energized in terms of instructions from the non-illustrated control unit of the printing machine, thereby moving the rod 20 and the mounting plate 14 toward the transfer medium web 4. The return spring 21 may be a coil spring for moving the mounting plate 14 away from the transfer medium web 4, through the rod 20.

The operation of the heat-sensitive printing machine having the construction thus far described will be described hereinbelow. Initially, the printing plate 12 is heated to a predetermined proper printing temperature by the action of the heater 11. Next, when the solenoid 16 is operated to move the link 17 to the right, as viewed in FIG. 2, in response to an actuating signal coming from the control unit of the printing machine, the L-shaped link 19 is turned clockwise around the pin 22 so that the rod 20 is forced down to bring the printing plate 12 at the lower end of the plate carriage 10 into contact with the laminated web of the heat-sensitive transfer medium 4 and the labels 2 placed on a platen 23. As a result, the printing ink is transferred from said heat-sensitive transfer medium 4 to the labels 1 so that the predetermined printing operation is carried out. Next, if the solenoid 16 is deenergized or released from its operation, the L-shaped link 19 is returned or turned counter-clockwise by the action of the return spring 21 so that rod 20, mounting plate 14 and plate carriage 10 are moved upwardly until restored to the initial position.

Thus, in the printing operation by the forced contact of the aforementioned printing plate 12, even if the parallelism between the type surfaces of the printing plate 12 and the surface of the platen 23, i.e., the surface of the laminated web of the transfer medium 4 and the labels 2, should be broken, the type surfaces will still be brought into uniform contact with the heat-sensitive transfer medium web 4 by the shock-absorbing action of the leaf springs 15 and 15', which are interposed between the mounting plate 14 and the plate carriage 10, so that the labels 2 can be printed with clear indicia having a uniform shade but without thin spots or skips. Moreover, the loss of the heat which would be transferred by conduction from the plate carriage 10 through the leaf springs 15 and 15' to the reciprocal actuator 13 can be reduced because of the small cross-sectional area of the leaf springs 15 and 15, thereby maintaining the type of the printing plate 12 at the proper printing temperature so that the power consumed for compensating the heat loss can be accordingly reduced.

Additionally, the elastic members interposed between the mounting plate 14 and the plate carriage 10 need not be limited to the above-specified leaf springs 15 and 15'. The desired purpose can be achieved if the elastic members have a cross-sectional area which conduct no more than about 20% of the heat supplied to the print head 5 by the heater 11 from the plate carriage 10 to the actuator 13.

Moreover, the heat-sensitive printing medium need not be limited to the case in which ordinary paper is printed through heat-sensitive transfer medium, as has been exemplified hereinbefore, but should be understood to naturally include the case in which labels, tags, etc. made of heat-sensitive paper are directly printed.

As has been described hereinbefore, according to the present invention, the plate carrier equipped with the printing plate and the heater is connected to the reciprocal actuator by means of the elastic members having the small cross-sectional area. As a result, an effect can be attained in that the type surfaces of the printing plates are forced into uniform contact with the heat-sensitive printing medium without fail, so that clear prints having neither thin spots nor skips can be obtained. Another effect is that the heat loss attributable to the heat conduction from the plate carrier to the reciprocal actuator is so remarkably reduced that the printing plate can be prevented from excessively cooling down from the proper printing temperature.

The present invention may be embodied in other specific forms without departing from the spirit or essential attributes thereof and, accordingly, reference should be made to the appended claims, rather than to the foregoing specification, as indicating the scope of the invention.

What is claimed is:

1. A heat-sensitive printing machine for pushing a hot printing plate against a heat-sensitive printing medium to print said printing medium with desired indicia, comprising:

a printing head including a printing plate having a plurality of types bearing said desired indicia, and a heater for heating the types of said printing plate to a proper printing temperature;

a reciprocal actuator for reciprocally bringing said printing head toward and away from a heat-sensitive printing medium to accordingly bring the types of said printing head into and out of contact with said heat-sensitive printing medium thereby to print said printing medium with the desired indicia of said types;

elastic support means for said printing head interconnecting said reciprocating actuator and said printing head;

said elastic means having a sufficiently small cross-sectional area to ensure that no more than about 20% of the heat in said printing head is conducted to said reciprocal actuator via said elastic means whereby the parallelism between the surfaces of the types of said printing plate and the surface of said printing medium can be ensured by the elasticity of said elastic means, and the loss of the heat, which will be transferred by conduction from said printing head through said elastic means to said reciprocal actuator, is kept small due to the small cross-sectional area of said elastic means thereby to maintain the types of said printing plate at said proper printing temperature with the accordingly reduced power consumption for compensating said heat loss; and said elastic means including a pair of leaf springs formed into a semi-circular shape and each having its one end connected to said printing head and its other end connected directly to said reciprocal actuator; the leaf springs in said pair being oriented so that the opening of said semicircular shape in each spring faces the opening of the other.

2. A heat-sensitive printing machine according to claim 1, wherein said printing head further includes a plate carriage accommodating said heater therein and having its one end carrying said printing plate and its other end connected to the one end of each of said leaf springs.

3. A heat-sensitive printing machine according to claim 2, wherein said reciprocal actuator includes:

a mounting plate mounting thereon the other end of each of said leaf springs;

a rod secured to said mounting plate at its one end and mounted in the frame of said printing machine such that it can be guided thereby to move back and forth;

an L-shaped link having its central portion hinged to said machine frame and its first end hingedly joined to the body of said rod;

a second link having its first end hingedly joined to a second end of said L-shaped link;

a solenoid connected to a second end of said second link and adapted to pull said link, when energized, thereby bringing said mounted plate toward said printing medium through said L-shaped link and said rod; and a return spring for biasing said L-shaped link at all times to return said mounting plate apart from said printing medium through said rod.

4. The heat-sensitive printing machine of claim 1, wherein said leaf springs together have a cross-sectional area of between 1.0 and 4.0 $mm^2$.

* * * * *